US005810353A

United States Patent [19]

Baskette et al.

[11] Patent Number: 5,810,353

[45] Date of Patent: Sep. 22, 1998

[54] MODULAR OUTPUT STACKERS FOR PRINTERS

[75] Inventors: Michael Wesley Baskette, Lexington; Billy Carl Chappel, Mt. Sterling; Randall Steven Gall; Michael Earl Kennedy, both of Lexington; Michael Craig Leemhuis, Nicholasville, all of Ky.

[73] Assignee: Lexmark International, Inc., Lexington, Ky.

[21] Appl. No.: 854,318

[22] Filed: May 12, 1997

[51] Int. Cl.[6] ..... B65H 39/10; B65H 29/00

[52] U.S. Cl. ..... 271/305; 271/279; 271/287; 271/298

[58] Field of Search ..... 271/279, 292, 271/297, 298, 303, 304, 305, 287, 288, 289, 290; 270/58.13, 58.14, 58.18, 58.28

[56] References Cited

U.S. PATENT DOCUMENTS 5,201,505 4/1993 Shah ..... 271/3

OTHER PUBLICATIONS

The Document Company Xerox, Xerox DocuPrint 4517/4517mp Network Laser Printers User Guide, 1994, 1995, selected pages.

*Primary Examiner*—Karen M. Young
*Assistant Examiner*—Thuy V. Tran
*Attorney, Agent, or Firm*—John A. Brady

[57] ABSTRACT

A printer has one or more stacked sheet output units on top of it for increasing the printer's output capacity. Each unit includes a housing having a diverter as does the printer. The position of each diverter is controlled by a diverter/drive mechanism in the unit stacked on top of it. In its first position, the diverter of the printer or the unit diverts a fed sheet from a substantially vertical path therein to a sheet receiving area. In its second position, the diverter allows the fed sheet to be advanced by driven rolls to the unit thereabove. The feed rolls of a unit are driven only when the diverter in each of the printer and in any unit therebeneath are in the second position.

6 Claims, 10 Drawing Sheets

MODULAR OUTPUT STACKERS FOR PRINTERS

FIELD OF THE INVENTION

This invention relates to a modular sheet output unit for use with a printer to enable the printer to have at least two stacks of output printed sheets and, more particularly, to a printer in which one or more modular sheet output units may be added.

BACKGROUND OF THE INVENTION

While media input capacities in printers have greatly increased in capacity and variety as printer speeds have increased, output capacity has generally failed to keep pace. In the few cases where additional output capabilities have been provided, these devices have generally been very large capacity, single-bin devices, typically at least 1500 sheets.

These relatively high capacity devices typically require the use of an elevator mechanism to elevate or move the sheet output stack to a level needed for good sheet stacking performance. This results in the devices being quite expensive.

Users presently are forced to select between the generally low output capacity of a printer, which is usually provided in a base output tray of the printer, or to add a relatively large amount of additional capacity in the form of an expensive elevator device.

In printers and other media sheet handling devices containing various handling options for each sheet of media, two primary mechanical tasks must be accomplished.

One is that each sheet of media must be transported through various devices and product options. The other is that each sheet must be directed or diverted to the specific device and option of interest.

Often, these two functions are performed independently with an individual, specific mechanism used to control each function independently. This arrangement provides the maximum amount of control and design flexibility because each function can be operated by itself. Accordingly, each mechanism can be designed largely independently of the other.

However, this arrangement requires the use of two prime movers, such as motors or solenoids, for example. Thus, this also is relatively expensive when an additional motor driver, control, and power, for example, are needed to operate the additional prime mover.

It is not always necessary to control the paper transport and diverting functions in a completely independent manner. For example, it is generally not necessary to run the sheet transport function of a device if the diverting mechanism, which feeds the device, is not positioned to feed each sheet into the device.

SUMMARY OF THE INVENTION

The present invention satisfactorily solves the foregoing problems. First, a lower cost sheet output unit is provided for increasing the output capacity of printers. Therefore, the present invention increases the output capacity of a printer with stacked sheet output units. While the capacity of the stacked sheet output units is less than that provided by the presently available high capacity devices, it is substantially greater than available in the base output tray of the printer.

Second, each of the stacked sheet output units performs the two specific functions of transport or feed of each sheet and of diverting each sheet with the use of only one prime mover. Each of the stacked sheet output units controls a diverter in a printer or in the stacked sheet output unit therebeneath to divert each sheet of media to an exit in the printer or the stacked sheet output unit therebeneath or to direct the sheet to the feed path in the stacked sheet output unit so that the sheet is advanced through the stacked sheet output unit to a sheet receiving tray supported by the stacked sheet output unit.

By stacking the sheet output units in a tower configuration, increased output capacity is provided along with multiple, addressable output locations. This extra capacity enables printer users to print large reports that would otherwise exceed the printer capacity since the print job can be deposited across multiple, addressable bins. The multiple, addressable bins also enable users to segregate jobs by each user, for example, "mailboxing."

An object of this invention is to provide a relatively inexpensive sheet output unit for a printer.

Another object of this invention is to provide an unique driving arrangement for a sheet output unit for a printer.

A further object of this invention is to provide a sheet output unit having a single motive means for moving a sheet feed path diverter and for advancing each sheet when it is to be fed through a sheet output unit.

Other objects of this invention will be readily perceived from the following description, claims, and drawings.

BRIEF DESCRIPTION OF THE DRAWINGS

The attached drawings illustrate a preferred embodiment of the invention, in which.

DETAILED DESCRIPTION OF PREFERRED EMBODIMENT

Figure 1:
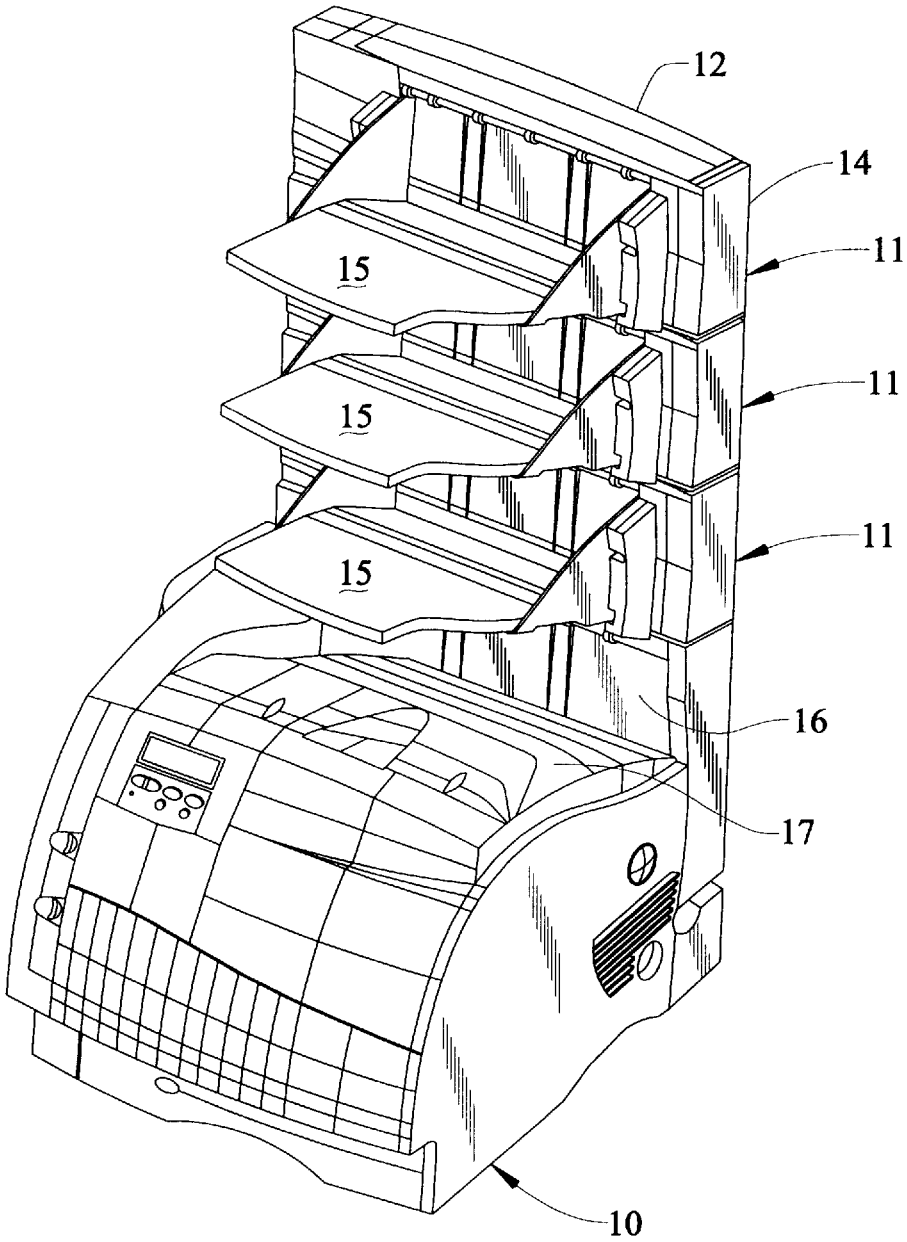
FIG. 1 is a perspective view of a printer having a plurality of the sheet output units of the present invention supported thereby.

Referring to the drawings and particularly FIG. 1, there is shown a printer 10 having a plurality of sheet output units 11 stacked on the printer 10 in a tower configuration. The uppermost of the sheet output units 11 has a cover 12 supported thereon. When the printer 10 has none of the stacked units 11 thereon, the cover 12 is disposed in the top of the printer 10 to close its opening.

Each of the sheet output units 11 has a housing 14, supporting a removable sheet receiving tray 15. Each of the sheet output units 11 has a sheet receiving tray 15 removably supported thereon. The printer 10 has a sheet receiving area defined by a substantially vertical wall 16 and a top curved wall 17 to receive sheets 18 (see FIG. 2) from the printer 10. The housing 14 of each of the sheet output units 11 has a substantially vertical feed path 19 extending from its bottom 20 to its top 21.

Figure 2:
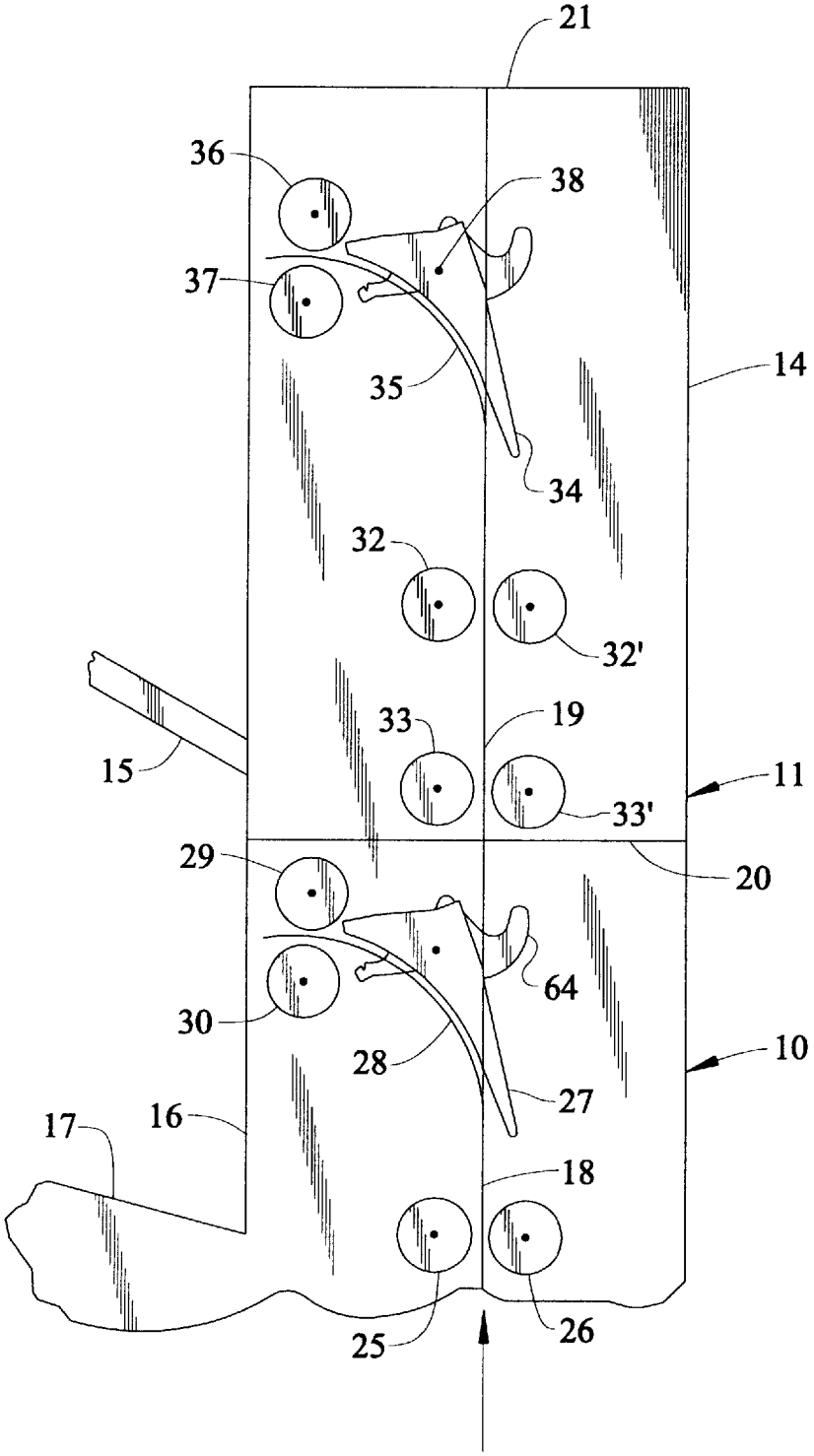
FIG. 2 is a schematic view of a portion of a printer and one of the sheet output units of FIG. 1 and showing the various sheet feed paths.

The feeding of one of the sheets 18 through the printer 10 and one of the sheet output units 11, which is mounted on top of the printer 10, is schematically shown in FIG. 2. The printer 10 has cooperating feed rolls 25 and 26 with the feed roll 25 being given and the feed roll 26 being spring biased for engagement therewith.

Figure 8:
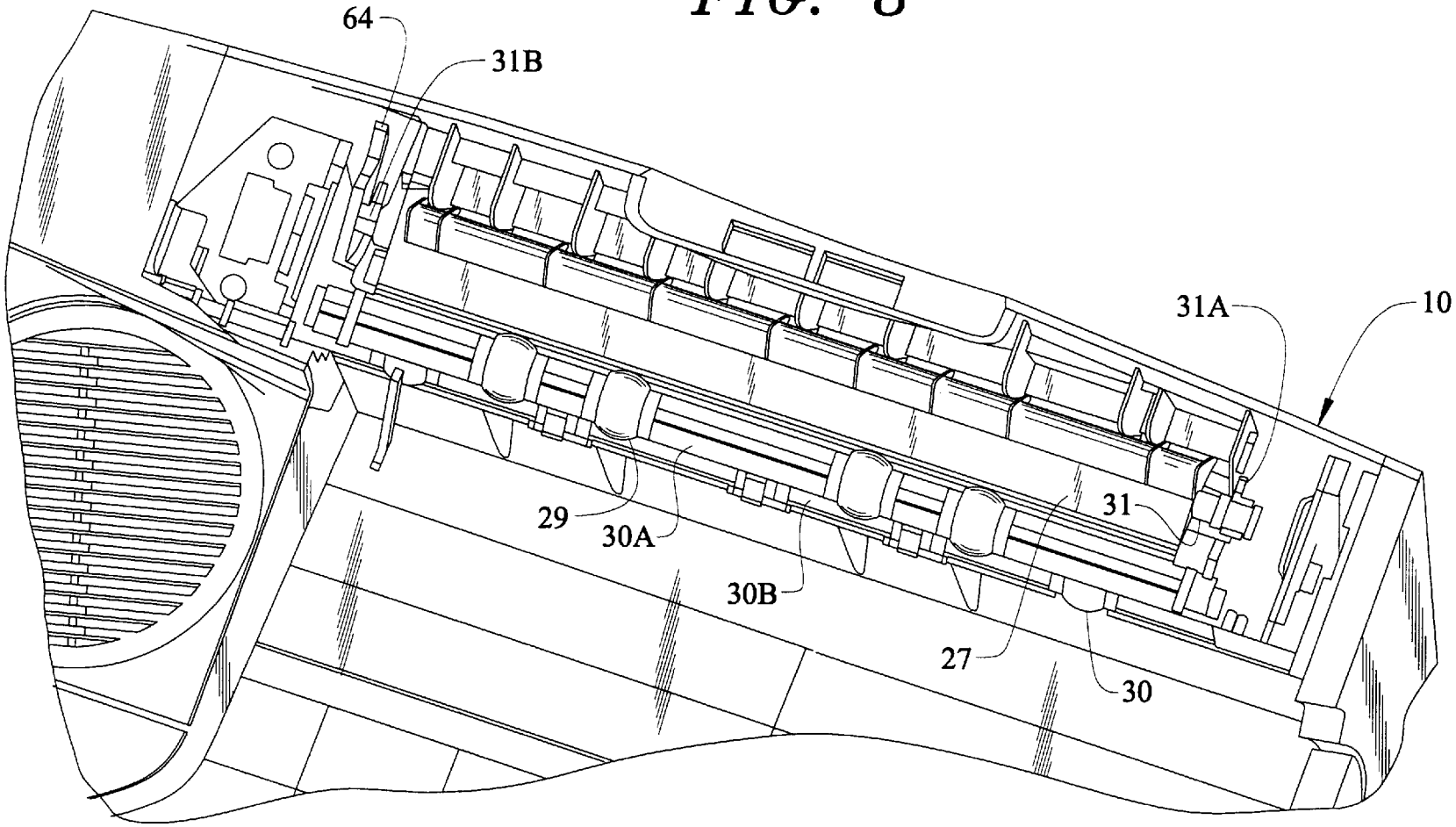
FIG. 8 is a top plan view of the printer of FIG. 1.

The printer 10 has a pivotally mounted diverter 27 movable between a position shown in FIG. 2 in which it diverts the sheet 18 of a media such as paper, for example, along a path 28 between two cooperating feed rolls 29 and 30. The feed rolls 29 are mounted on a shaft 30A (see FIG. 8), and the feed rolls 30 are mounted on a shaft 30B. Each of the shafts 30A and 30B is driven by a motor (not shown) in the printer 10 to rotate the feed rolls 29 and 30.

Accordingly, when the diverter 27 is in the position of FIG. 2, the sheet 18 is advanced along the feed path 28 to the feed rolls 29 and 30 from which the sheet 18 exits to the printer 10. The sheet 18 is collected in the sheet receiving area, which is defined by the walls 16 and 17 as previously mentioned.

The diverter 27 is fixed to its support shaft 31 (see FIG. 8), which is rotatably supported in portions 31A (see FIG. 8) and 31B of the printer 10. When the diverter 27 and the support shaft 31 are rotated clockwise (as viewed in FIG. 2) about the axis of the support shaft 31 (see FIG. 5), the sheet 18 (see FIG. 2) can be advanced to the substantially vertical feed path 19 in the housing 14.

The substantially vertical feed path 19 in the housing 14 of the sheet output unit 11 is defined by two pairs of vertically spaced cooperating feed rolls 32 and 32' and cooperating feed rolls 33 and 33'. The feed rolls 32 and 33 are driven while the feed rolls 32' and 33' are resiliently biased into engagement with the driven feed rolls 32 and 33, respectively.

The housing 14 of the sheet output unit 11 has a pivotally mounted diverter 34.

The diverter 34 is shown in FIG. 2 in the position in which it blocks feeding of the sheet 18 to the top 21 of the housing 14. In this blocking or diverting position of the diverter 34, the sheet 18 is fed along a path 35 to a pair of cooperating feed rolls 36 and 37. Each of the rolls 36 and 37 is driven.

The diverter 34 is fixed to its support shaft 38, which is supported in the housing 14 in the same manner as the diverter 27 is supported in the printer 10. When the diverter 34 and the support shaft 38 are rotated clockwise from the diverting position in FIG. 2 about the axis of the support shaft 38, the diverter 34 no longer blocks the substantially vertical feed path 19 so that the sheet 18 can advance through the top 21 of the housing 14 to the next of the sheet output units 11. Of course, if there is not another of the sheet output units 11 mounted on top of the sheet output unit 11 of FIG. 2, the cover 12 (see FIG. 1) would be supported on the top of the housing 14 of the sheet output unit 11.

The housing 14 has a divert/drive bracket 40 (see FIG. 3) supported thereon. The bracket 40 has an electric motor 41 mounted on one side of a substantially vertical wall 42. The motor 41 has its output shaft 43, which has an output gear 44 fixed thereto for rotation therewith, extend through a hole 45 in the wall 42.

Figure 6:
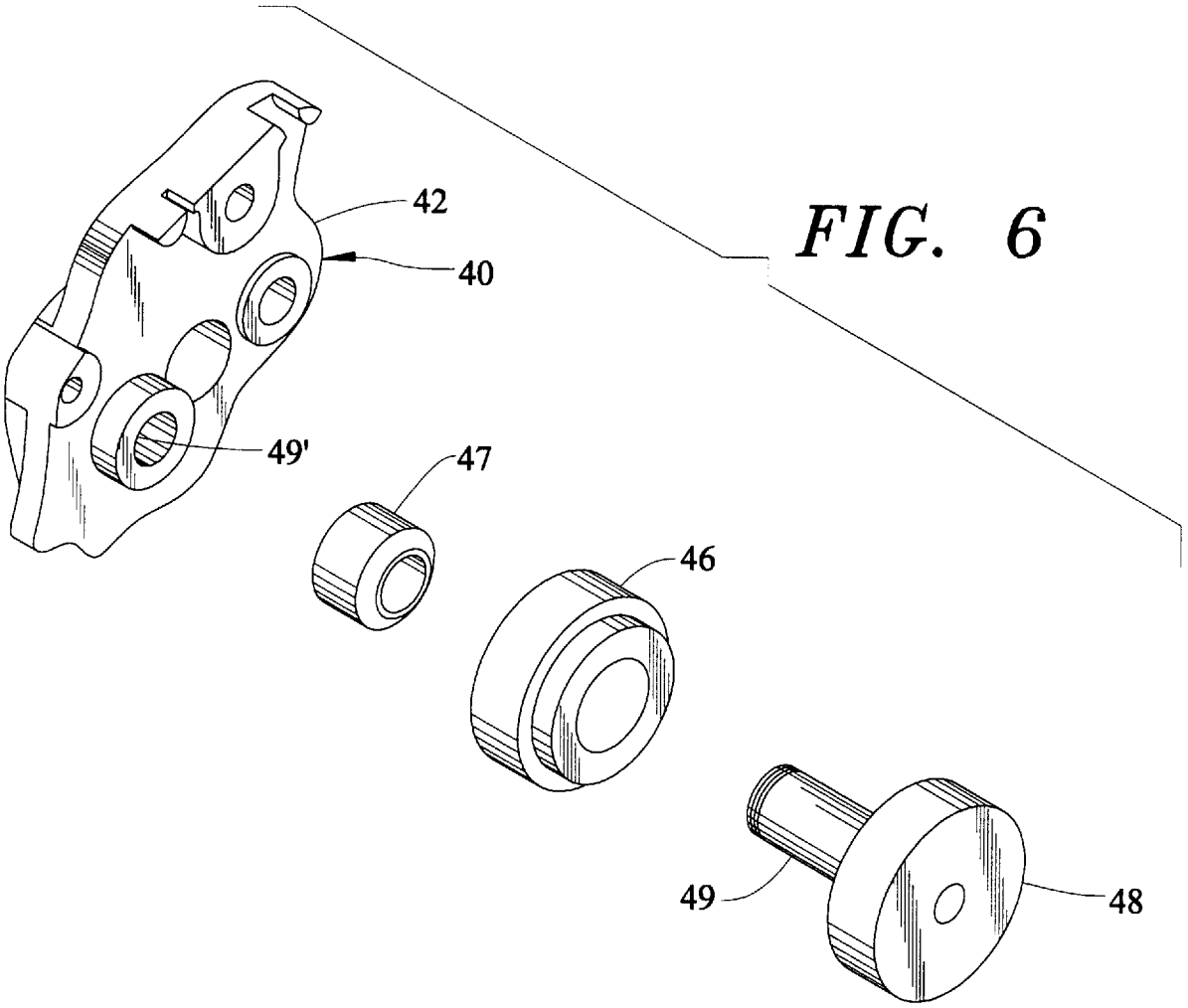
FIG. 6 is an exploded perspective view of a clutch gear, a reverse drive gear, and a wall of the diverter/drive mechanism.

The output gear 44 meshes with a clutch gear 46. The clutch gear 46 has a one-way clutch 47 (see FIG. 6) press fitted therein. A reverse drive gear 48 has its drive shaft 49 rotatably supporting the one-way clutch 47. The drive shaft 49 is supported within a passage 49' in the wall 42 of the divert/drive bracket 40.

The output gear 44 (see FIG. 3) also meshes with a first forward drive gear 50. The first forward drive gear 50 is mounted on a stud 51 supported by the wall 42 of the divert/drive bracket 40. A second forward drive gear 52 also is rotatably supported by the stud 51 and is integral with the first forward drive gear 50 so that they rotate together.

The output gear 44, the clutch gear 46, and the first forward drive gear 50 are helical gears to reduce noise. Otherwise, the first forward drive gear 50 and the second forward drive gear 52 could be a single gear.

Each of the reverse drive gear 48 and the second forward drive gear 52 mesh with teeth on a sector gear 53. The sector gear 53 is rotatably supported on a stud 54 extending from the wall 42 of the divert/drive bracket 40.

Figure 3:
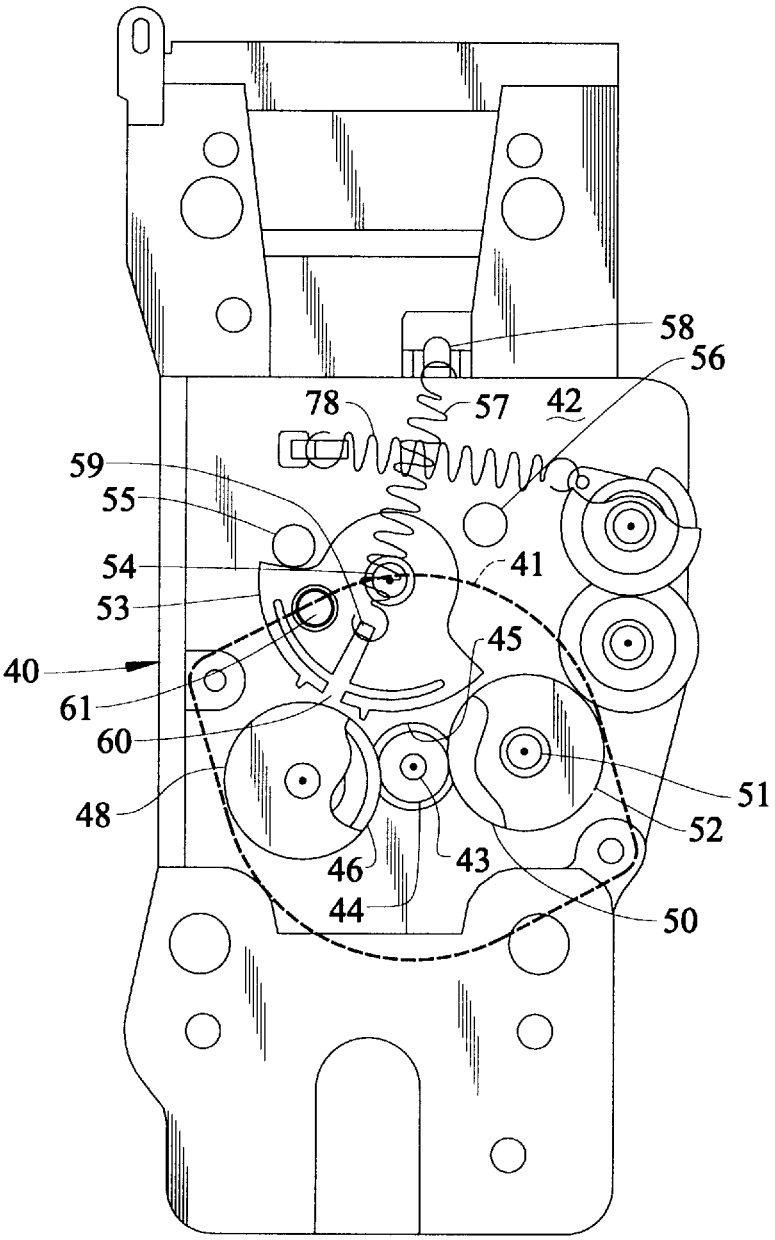
FIG. 3 is a side elevational view of a diverter/drive mechanism for shifting a diverter with the mechanism shown in the position in which the diverter is blocking feeding of the sheet to the sheet output unit thereabove.
Figure 4:
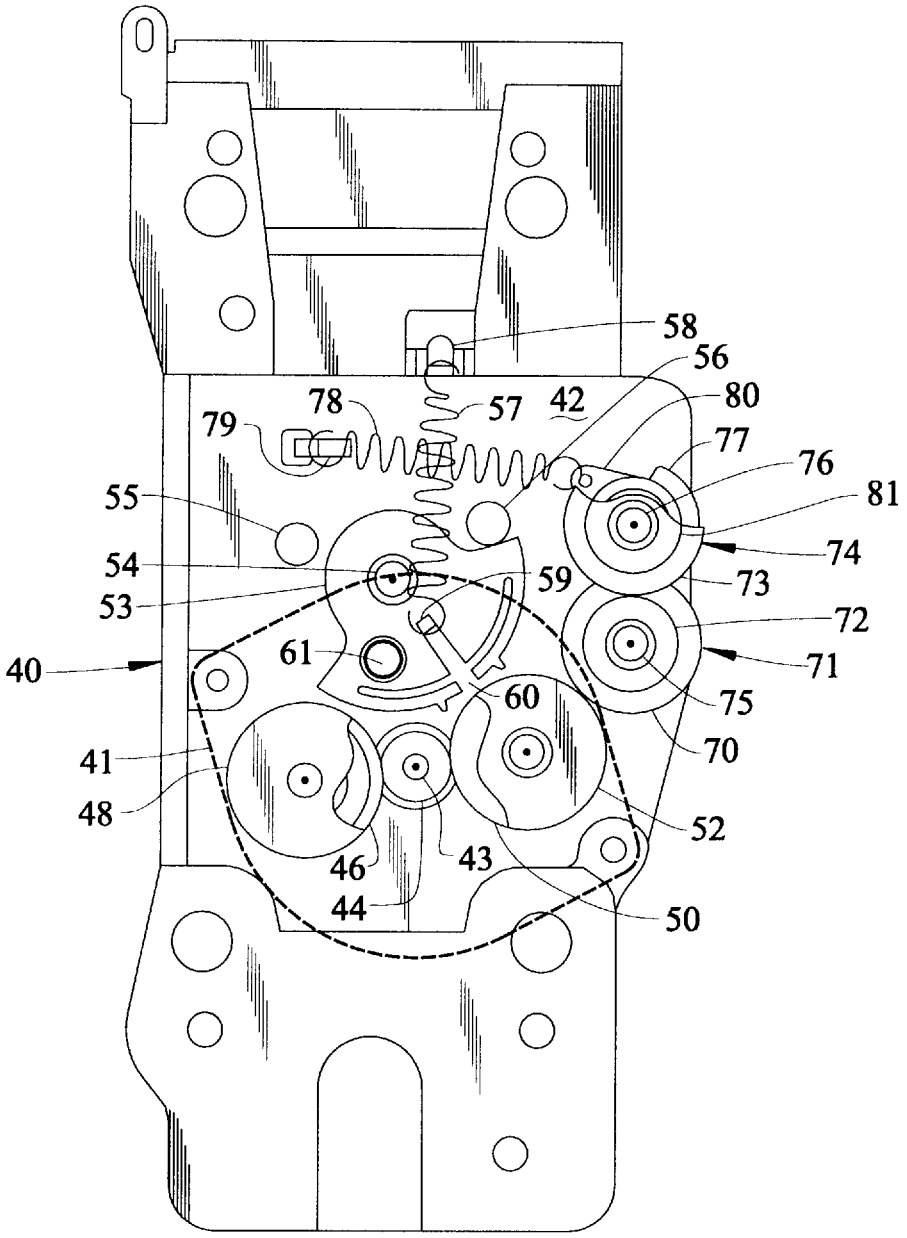
FIG. 4 is a side elevational view of the diverter/drive mechanism of FIG. 3 with the mechanism shown in the position in which the diverter is not blocking feeding of a sheet of media to the sheet output unit thereabove.

The sector gear 53 is rotatable about the stud 54 between the positions of FIGS. 3 and 4. In the position of FIG. 3, the sector gear 53 engages a first stop pin 55 on the wall 42 of the divert/drive bracket 40. In the position of FIG. 4, the sector gear 53 engages a second stop pin 56.

A toggle spring 57 extends between a projection 58 on the divert/drive bracket 40 to a projection 59 on the sector gear 53. The toggle spring 57 holds the sector gear 53 in the position of FIG. 3 or 4.

When the sector gear 53 is in the position of FIG. 3, its teeth interrupted area 60 cooperates with the reverse driver gear 48 so that there is no meshing of the teeth on the sector gear 53 with the teeth on the reverse drive gear 48.

In the position of FIG. 3, the sector gear 53 has its output pin 61 disposed so that the diverter 27 (see FIG. 2) is in its diverted position of FIG. 2.

The output pin 61 has a push rod 63 (see FIG. 5) extending therefrom for disposition in a diverter actuating arm 64. In the position shown in FIG. 5, the push rod 63 is not affecting the diverter 27. Accordingly, the diverter 27 remains in the diverting position of FIG. 2.

Figure 5:
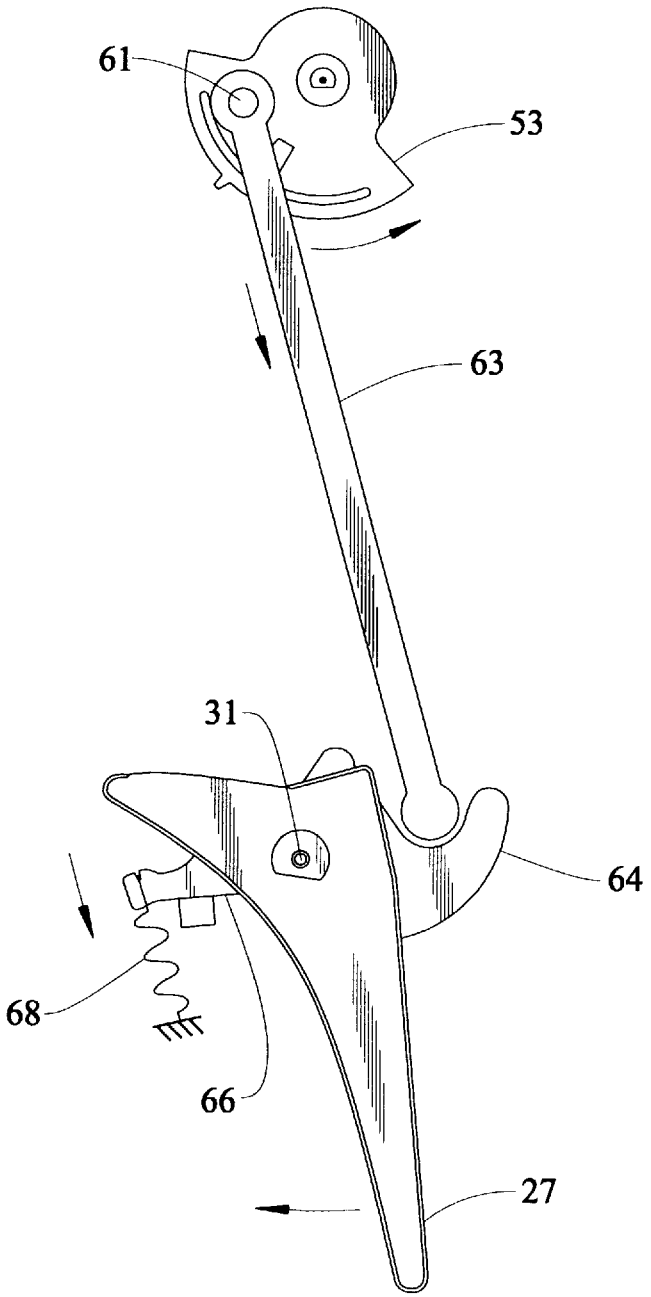
FIG. 5 is a schematic view of the arrangement for shifting the position of a diverter.

As shown in FIG. 5, a spring 68 acts on the arm 64 to continuously urge the diverter 27 to the position of FIG. 2. The diverter actuating arm 64 (see FIG. 5) is fixed to the shaft 31 of the diverter 27. The housing 14 (see FIG. 1) has a stop 66 (see FIG. 5) to limit the amount of movement of the diverter 27 by the spring 68.

When it is desired to shift the position of the diverter 27 (see FIG. 2) to a position in which it does not block the feed of the sheet 18 to the housing 14 of the feed output unit 11, the sector gear 53 (see FIG. 3) is rotated counterclockwise to the position of FIG. 4. This is accomplished by energizing the motor 41 with a signal from a microprocessor of the printer 10 (see FIG. 1). This results in the second forward drive gear 52 being rotated clockwise to cause counterclockwise rotation of the sector gear 53.

While the clutch gear 46 also is driven clockwise, the reverse drive gear 48 is not driven. This is because of the one-way clutch 47 (see FIG. 6) not transmitting rotation of the clutch gear 46 to the reverse drive gear 48 in this direction.

The sector gear 53 (see FIG. 4) is rotated counterclockwise until the interrupted teeth area 60 in the sector gear 53 has the second forward drive gear 52 positioned thereover. When this occurs, the sector gear 53 is engaging the second stop pin 56. The toggle spring 57 holds the sector gear 53 in this position after it is advanced against the second stop pin 56.

This cooperation of the interrupted teeth area 60 in the sector gear 53 with the second forward drive gear 52 allows the second forward drive gear 52 to continue to rotate after the sector gear 53 engages the second stop pin 56.

This rotation of the second forward drive gear 52 rotates a larger portion 70 of a compound gear 71. The compound gear 71 has a smaller portion 72 meshing with, a larger portion 73 of a compound gear 74.

The compound gear 71 is rotatably supported on a stud 75, and the compound gear 74 is rotatably supported on a stud 76. The stud 75 extends from the wall 42 of the divert/drive bracket 40.

The stud 76 is supported in a collar 77. The collar 77 is rotatably supported on the stud 75.

Figure 7:
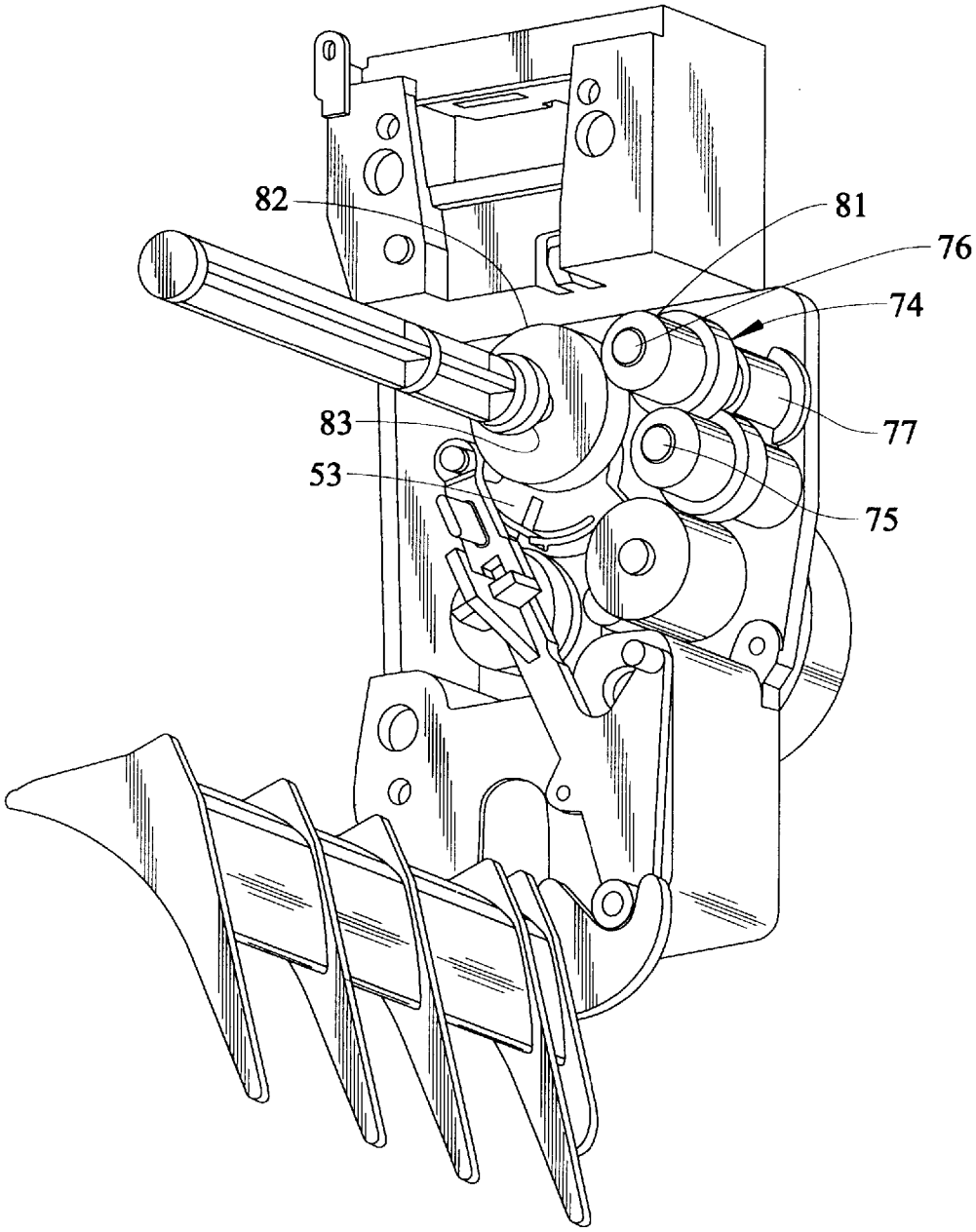
FIG. 7 is a fragmentary rear perspective view of a portion of the diverter/drive mechanism.

A spring 78 (see FIG. 4) extends between a projection 79 on the wall 42 of the divert/drive bracket 40 and an ear 80 on the collar 77. The spring 78 continuously urges a smaller portion 81 of the compound gear 74 into engagement with a gear 82 (see FIG. 7) on one end of a shaft 83 having the feed rolls 32 (see FIG. 2) mounted thereon in spaced axial relation.

The shaft 83 has a gear on its other end. This transmits drive to a shaft having the feed rolls 33 and to shafts having the feed rolls 36 and 37.

As previously mentioned, shifting of the sector gear 53 (see FIG. 3) from the position of FIG. 3 to the position of FIG. 4 causes the push rod 63 (see FIG. 5) to act on the diverter actuating arm 64. This shifts the position of the diverter 27 so that it no longer blocks advancement of the sheet 18 (see FIG. 2) to the substantially vertical feed path 19 in the housing 14 of the sheet output unit 11.

Accordingly, the feed rolls 32 (see FIG. 2), 33, 36, and 37 are not activated unless the diverter 27 is in its position in which it does not block advancement of the sheet 18 to the substantially vertical feed path 19 in the housing 14 of the sheet output unit 11.

It should be understood that the diverter 34 of the housing 14 of the sheet output unit 11 would similarly be controlled if another of the sheet output units 11 is on top of the sheet output unit 11, which is resting on top of the printer 10 as shown in FIG. 2. If another of the sheet output units 11 is not above the sheet output unit 11 of FIG. 2, then the diverter 34 will always be in the position shown in FIG. 2. This results in the sheet 18 being directed along the feed path 35 to be fed by the driven feed rolls 36 and 37 to the sheet receiving tray 15.

If only one of the sheet aligning units 11 is employed, then the top 21 of the housing 14 is closed by the cover 12 (see FIG. 1).

To change the position of the diverter 27 (see FIG. 2) from the position in which it does not block the sheet 18 from advancing to the substantially vertical feed path 19 in the housing 14 (This is the "accept" position.) to the position in which the diverter 27 is in its blocking position as shown in FIG. 2, a signal must supplied from the microprocessor in the printer 10 to the motor 41 (see FIG. 4). This signal causes the output shaft 43 of the motor 41 to rotate clockwise.

Clockwise rotation of the shaft 43 causes both the clutch gear 46 and the first forward drive gear 50 to rotate counterclockwise. Because the interrupted teeth area 60 in the sector gear 53 is positioned so that there can be no drive initially from the second forward drive gear 52 to the sector gear 53, it is only the rotation of the reverse drive gear 48 that causes counterclockwise rotation of the sector gear 53.

When the sector gear 53 reaches the position of FIG. 3, the reverse drive gear 48 no longer can mesh with the teeth on the sector gear 53 because of the interrupted teeth area 60 cooperating with the reverse drive gear 48. At this time, the sector gear 53 is engaging the first stop pin 55.

This position of the sector gear 53 disposes the push rod 63 (see FIG. 5) in the position of FIG. 5 so that it no longer engages the diverter actuating arm 64. Accordingly, the spring 65 moves the diverter actuating arm 64 into engagement with the stop 66. This returns the diverter 27 to the position in which it diverts the sheet 18 (see FIG. 2) to the feed rolls 29 and 30.

The motor 41 (see FIG. 3) is deenergized by a signal from the microprocessor of the printer 10 (see FIG. 1) when the sector gear 53 (see FIG. 3) is engaging the first stop pin 55. The toggle spring 57 holds the sector gear 53 in this position until the motor 41 is again energized to rotate the shaft 43 counterclockwise.

Figure 9:
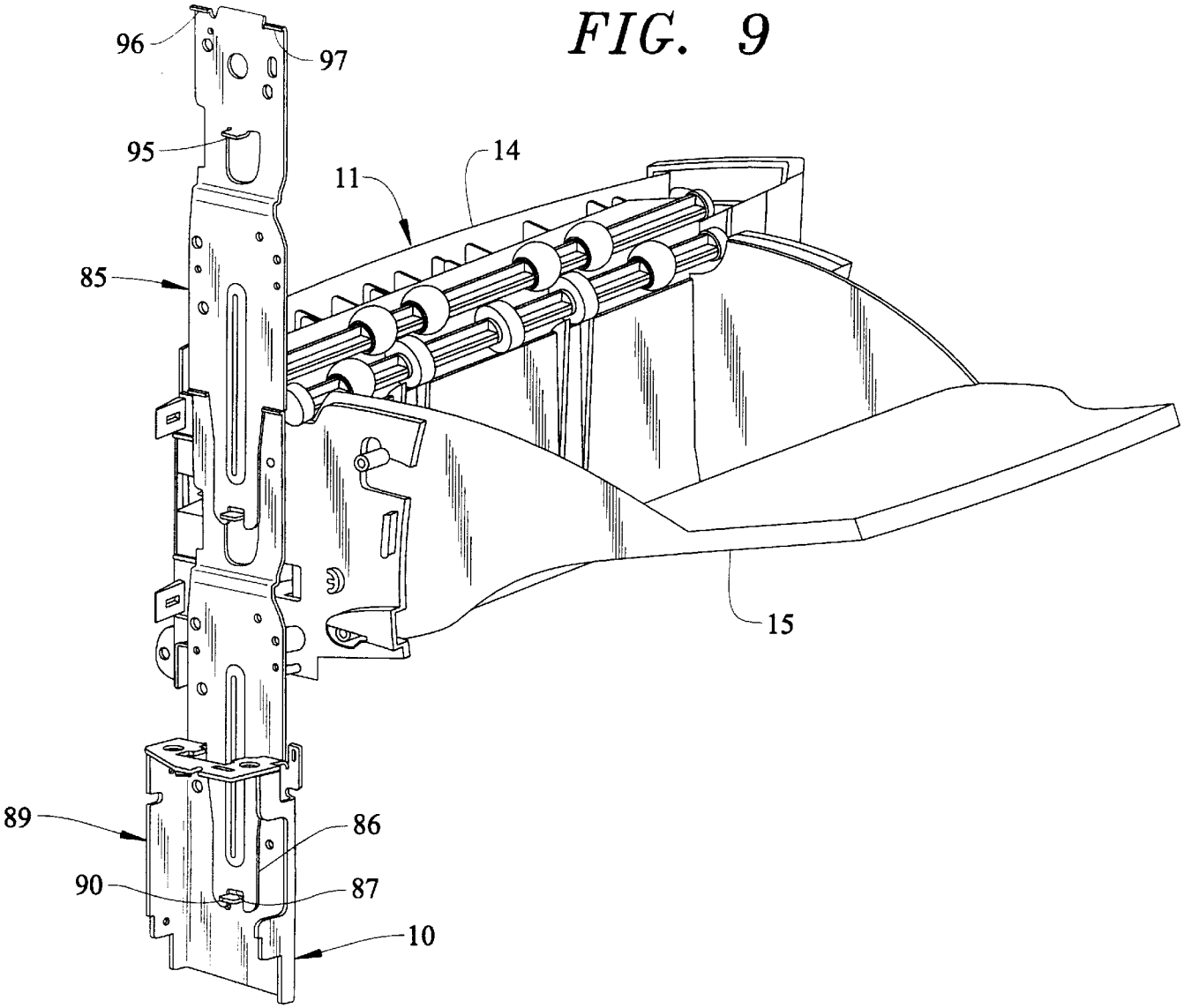
FIG. 9 is a perspective view of one of the sheet output units of FIG. 1 with parts omitted for clarity purposes and showing a mounting bracket supported by the housing.
Figure 10:
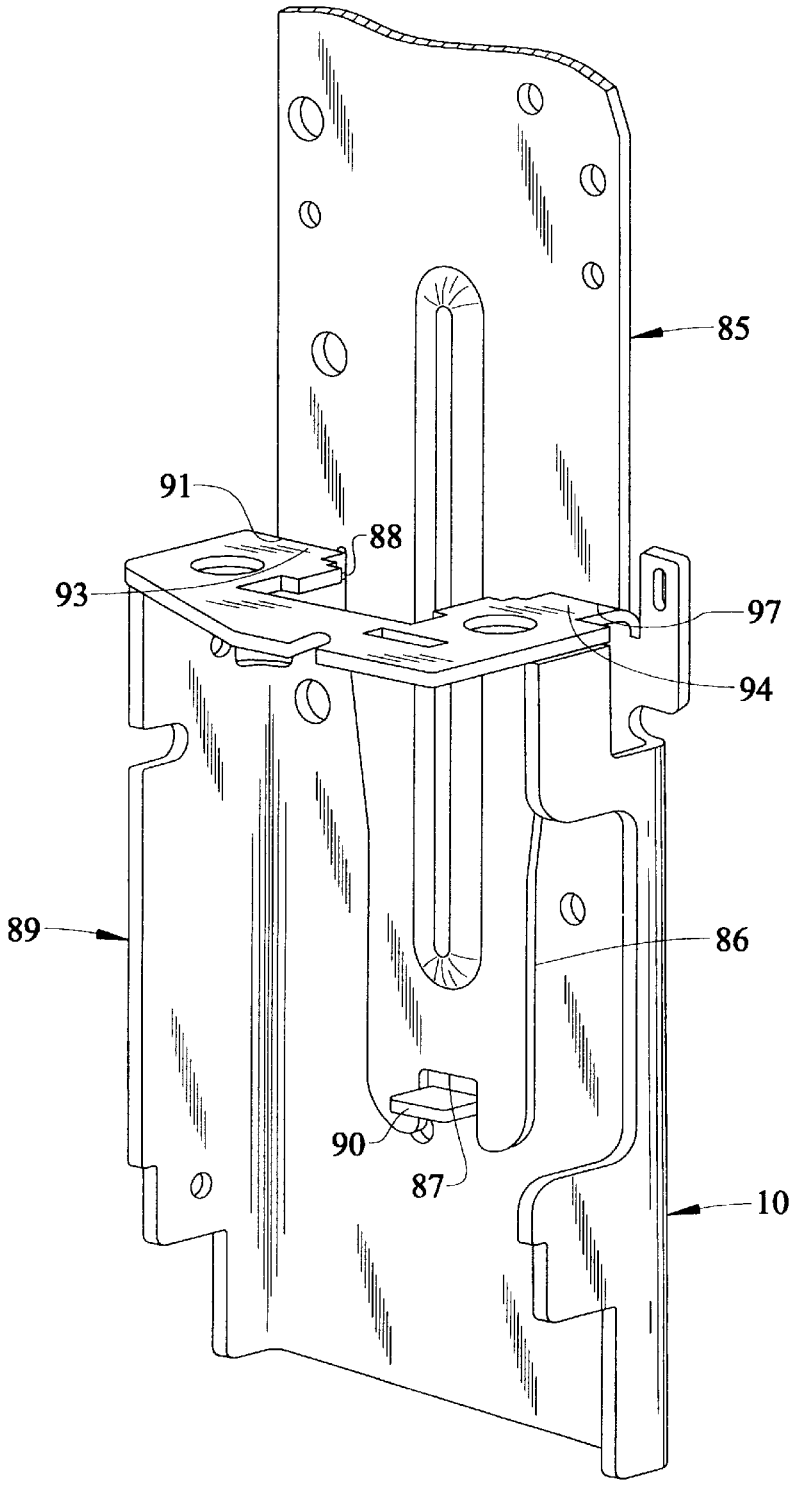
FIG. 10 is an enlarged fragmentary perspective view of a portion of the mounting bracket and a stacking tube of a printer of FIG. 9.

The housing 14 of the sheet output unit 11 has a pair of mounting brackets 85 (one shown in FIG. 9) extending downwardly therefrom adjacent opposite sides of the housing 14. The two mounting brackets 85 retain the sheet output unit 11 on the printer 10 or on another of the sheet output units 11. Each of the mounting brackets 85 has its reduced bottom portion 86 (see FIG. 10) formed with a slot 87 in its bottom surface.

When the reduced bottom portion 86 of the mounting bracket 85 is disposed within a mounting slot 88 in a stacking tube 89 of the printer 10, the slot 87 receives a tab 90 on the stacking tube 89. Each of the mounting brackets 85 has a pair of shoulders 91 and 92 at the top of the reduced bottom portion 86 for engagement with substantially horizontal surfaces 93 and 94, respectively, of the stacking tube 89 of the printer 10.

Thus, the sheet output unit 11 may be inserted vertically into the printer 10. The sheet output unit 11 is prevented from being twisted by the load of the sheets 18 and any other of the sheet output units 11 through engagement of the slot 87 with the tab 90. The vertical position is controlled by engagement of the shoulders 91 and 92 with the substantially horizontal surfaces 93 and 94, respectively, of the stacking tube 89.

The housing 14 (see FIG. 9) has a similar arrangement to the printer 10. Instead of having the stacking tube 89, the upper end of the mounting bracket 85 in the housing 14 has a tab 95 to be received in the slot 87 of the mounting bracket 85 in the housing 14 of the sheet output unit 11 disposed on top of the housing 14 supported on the printer 10. The shoulders 91 and 92 of the mounting bracket 85 supported by the housing 14 of the sheet output unit 11 disposed on top of the housing 14 supported on the printer 10 rest on two flanges 96 and 97, respectively, at the top of the mounting bracket 85 supported on the housing 14 disposed on top of the printer 10.

While the push rod 63 (see FIG. 5) has been shown as the device for actuating the diverter 27, it should be understood that rotational motion could be employed for actuating the diverter 27. With rotational output instead of linear output as provided by the push rod 63, the amount of rotation of the sector gear 53 could be modified by changing the relative distance and/or position of the sector gear 53 and the diverter 27, changing the relative location of the stud 54 (see FIG. 3) in the sector gear 53, and adjusting the amount of rotation of the sector gear 53 between its two positions by changing the angular relationships between the clutch gear 46 and the first forward drive gear 50 relative to the sector gear 53.

It should be understood that a one-way clutch could be employed between the first forward drive gear 50 and the second forward drive gear 52 in the same manner as the one-way clutch 47 (see FIG. 6) is employed between the clutch gear 46 and the reverse drive gear 48. In such an arrangement, the one-way clutch used between the first forward drive gear 50 (see FIG. 3) and the second forward drive gear 52 must be oriented to provide drive and free rotation in directions opposite to that of the reverse drive gear 48.

An advantage of this invention is that it increases the output storage capacity of a printer without requiring an expensive elevator device. Another advantage of this invention is that it eliminates the need for separate motive means for positioning the diverter and the sheet feed means.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. A sheet output unit for mounting on a printer or another sheet output unit including:

a housing having a substantially vertical feed path extending from its bottom to its top;

said housing having support means for supporting said housing on a printer or on a sheet output unit disposed therebeneath;

said housing having sheet advancing means for advancing each sheet along the substantially vertical feed path;

sheet receiving means supported by said housing;

and diverting means in said housing for diverting each fed sheet from the substantially vertical feed path to said sheet receiving means when said diverting means is in a first position and to allow each fed sheet to move along the substantially vertical feed path from the bottom to the top of said housing when said diverting means is in a second position;

said sheet output unit having a top cover when said sheet output unit does not have another sheet output unit mounted above it.

2. The sheet output unit according to claim 1 in which said sheet advancing means includes:

feed drive means;

and driving means for driving said feed drive means when a sheet is to be fed to the substantially vertical feed path.

3. The sheet output unit according to claim 1 including means for activating said sheet advancing means only when a sheet is to be fed along the substantially vertical feed path in said housing.

4. The sheet output unit according to claim 1 including means for continuously urging said diverting means to its first position.

5. In combination:

a printer having a top surface and having a substantially vertical feed path at least directly adjacent said top surface;

a sheet output unit including a housing having a substantially vertical feed path extending from its bottom to its top;

said housing having support means for supporting said housing on said top surface of said printer to cause the substantially vertical feed path in said housing to communicate with the substantially vertical feed path in said printer;

said housing having sheet advancing means for advancing each sheet along the substantially vertical feed path in said housing;

said printer having sheet receiving means and having diverting means for diverting each fed sheet from the substantially vertical feed path of said printer to said sheet receiving means of said printer when said diverting means is in a first position and to allow each fed sheet to move along the substantially vertical feed path of said printer to the substantially vertical feed path in said housing of said sheet output unit supported by said printer when said diverting means is in a second position;

sheet receiving means supported by said housing;

said housing having diverting means for diverting each fed sheet from the substantially vertical feed path to said sheet receiving means supported by said housing when said diverting means is in a first position and to allow each fed sheet to move along the substantially vertical feed path from the bottom to the top of said housing when said diverting means is in a second position;

control means for controlling whether said diverting means of said printer is in its first position or its second position;

electric motive means supported by said housing;

an output gear driven by said electric motive means;

forward drive gear means driven by said output gear for disposing said diverting means of said printer in a position to allow sheet feed from the substantially vertical feed path in said printer to the substantially vertical feed path in said housing and for driving said sheet advancing means when said output gear is driven in one rotary direction;

a reverse drive gear driven by said output gear in the same rotary direction as said forward drive gear means for disposing said diverting means of said printer in a position to prevent sheet feed from the substantially vertical feed path in said printer to the substantially vertical feed path in said housing when said output gear is driven in the opposite rotary direction;

a sector gear selectively meshing with each of said forward drive gear means and said reverse drive gear, said sector gear having an interrupted teeth area;

first and second stopping means for stopping movement of said sector gear in each rotary direction after said interrupted teeth area is engaged by one of said forward drive gear means and said reverse drive gear;

said forward drive gear means continuing to drive said sheet advancing means after said forward drive gear means is in engagement with said interrupted teeth area of said sector gear and said sector gear is in engagement with said first stopping means;

said reverse drive gear driving said sector gear until said sector gear engages said second stopping means when the rotation of said output gear is reversed;

and holding means for holding said sector gear against said first stopping means or said second stopping means.

6. In combination:

a printer having a top surface and having a substantially vertical feed path directly adjacent said top surface;

at least two sheet output units with one of said two sheet output units vertically stacked on the other and the other of said two sheet output units stacked on the printer;

each of said sheet output units including;

a housing having a substantially vertical feed path extending from its bottom to its top;

said housing having support means for supporting said housing on said top surface of said printer or on a lower mounted sheet output unit;

and sheet advancing means supported by said housing for advancing each sheet along the substantially vertical feed path;

said printer having sheet receiving means and having diverting means for diverting each fed sheet from the substantially vertical feed path of said printer to said sheet receiving means of said printer when said diverting means is in a first position and to allow each fed sheet to move along the substantially vertical feed path of said printer to the substantially vertical feed path in said housing of said sheet support unit supported by said printer when said diverting means is in a second position;

each of said sheet output units having sheet receiving means supported by said housing;

said housing of each of said sheet output units having diverting means for diverting each fed sheet from the substantially vertical feed path to said sheet receiving means when said diverting means is in a first position and to allow each fed sheet to move along the substantially vertical feed path from the bottom to the top of said housing when said diverting means is in a second position;

control means for controlling whether said diverting means of said printer or said lower mounted sheet output unit is in its first position or its second position;

electric motive means supported by said housing;

an output gear driven by said electric motive means;

forward drive gear means driven by said output gear for disposing said diverting means of said printer or said lower mounted sheet output unit in a position to allow sheet feed from the substantially vertical feed path in said printer or said lower mounted sheet output unit to the substantially vertical feed path in said housing and for driving said sheet advancing means when said output gear is driven in one rotary direction;

a reverse drive gear driven by said output gear in the same rotary direction as said forward drive gear means for disposing said diverting means of said printer or said lower mounted sheet output unit in a position to prevent sheet feed from the substantially vertical feed path in said printer or said lower mounted sheet output unit to the substantially vertical feed path in said housing when said output gear is driven in the opposite rotary direction;

a sector gear selectively meshing with each of said forward drive gear means and said reverse drive gear, said sector gear having an interrupted teeth area;

first and second stopping means for stopping movement of said sector gear in each rotary direction after said interrupted teeth area is engaged by one of said forward drive gear means and said reverse drive gear;

said forward drive gear means continuing to drive said sheet advancing means after said forward drive gear means is in engagement with said interrupted teeth area of said sector gear and said sector gear is in engagement with said first stopping means;

said reverse drive gear driving said sector gear until said sector gear engages said second stopping means when the rotation of said output gear is reversed;

and holding means for holding said sector gear against said first stopping means or said second stopping means.

* * * * *